US006457611B1

(12) United States Patent
Koehler

(10) Patent No.: US 6,457,611 B1
(45) Date of Patent: Oct. 1, 2002

(54) PILL DISPENSER LOADER

(76) Inventor: Charles P. Koehler, 5511 Chestnut La., McFarland, WI (US) 53558

( * ) Notice: Subject to any disclaimer, the term of this patent is extended or adjusted under 35 U.S.C. 154(b) by 0 days.

(21) Appl. No.: 09/834,677

(22) Filed: Apr. 13, 2001

(51) Int. Cl.[7] ..... B67D 3/00

(52) U.S. Cl. ..... 222/462; 222/485; 222/561; 141/243; 141/247

(58) Field of Search ..... 222/145.4, 460, 222/462, 484, 485, 486, 561; 141/237, 242, 243, 247

(56) References Cited

U.S. PATENT DOCUMENTS 244,208 A * 7/1881 Reymond ..... 141/247
5,765,606 A * 6/1998 Takemasa et al. ..... 141/247
5,992,709 A * 11/1999 Gray et al. ..... 222/485
6,126,375 A * 10/2000 O'Brien ..... 222/485

* cited by examiner

*Primary Examiner*—Joseph A. Kaufman
(74) *Attorney, Agent, or Firm*—Lathrop & Clark LLP

(57) ABSTRACT

A loader for an automated pill dispenser has a plastic body with two rows of pill cavities which are positioned to overlie pill compartment blocks in the speciality pill dispensing carousel of a conventional automated pill dispenser. Two guides affixed beneath the loader body restrain a flat floor member, which has a handle to permit it to be moved between a retracted loading positioned and an extended dispensing position. The floor member has a single slot running its width through which front row pill cavities empty when the floor member is extracted. The guides define positioning holes which allow the loader to be rapidly brought into position with respect to the automated pill dispenser drawer. The loader may be filled with pills at a location remote from the automated dispenser, and rapidly engaged with and removed from the dispenser to most effectively make use of the dispenser's processing time.

17 Claims, 4 Drawing Sheets

PILL DISPENSER LOADER

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to automated dispensing equipment in general, and to devices for loading automated pill dispensers in particular.

Tremendous strides in pharmacology have developed treatments for numerous human ailments which were once debilitating or fatal, but which are now readily controllable with careful medication. The modem medical practitioner has available a vast pharmacopeia for treatment of a wide range of physical and mental afflictions. Technological advancements in the development and production of pharmaceuticals has been accompanied by mechanical and electrical advancements in the development of automated machinery such that, at the present time, automated dispensers of pill form medicaments are widely used to collect in convenient labeled packets just those pills which are to be consumed by a particular patient at a particular time.

In hospitals, nursing homes, extended care facilities, and other institutions caring for multiple patients, automated pill dispensers can contribute to the expeditious, sanitary, and accurate distribution of necessary medications. In one known automated pill dispenser, several hundred 10-inch tall canisters within the apparatus are loaded with the most common medications required by the patients served by the dispenser. Under computer control, the dispenser collects just those pills required for a particular patient and routes them into a labeled packet. However, even with several hundred medications available on demand, there are always specialized patient needs requiring medications not loaded in one of the large canisters of the dispenser. To attend to the need for specialized medications, the automated pill dispensers are outfitted with a retractable carousel having 20 to 60 cavities into which small quantities of pills may be loaded. This specialty carousel is mounted on slides which permit it to be extracted from the process path of the dispenser where each numbered carousel compartment may be loaded by hand with a particular medication whose identity is keyed into the controlling computer. The drawbacks of this system are readily apparent: the expensive automated dispenser must be halted while the carousel is retracted and loaded, reducing the productivity of the machine, and consuming additional labor; moreover, individual loading of carousel cavities under time pressure places undue stress on operating personnel.

What is needed is an apparatus for loading medications into an automated pill dispenser specialty carousel which reduces machine downtime, relieves operator pressures, and facilitates accurate and expeditious medication dispensing.

SUMMARY OF THE INVENTION

The loader for an automated pill dispenser of this invention has a plastic body with two rows of pill cavities which are positioned to overlie the pill compartment blocks in the speciality pill dispensing carousel of a conventional automated pill dispenser. Two guides affixed beneath the loader body restrain a flat floor member, which has a handle to permit it to be moved between a retracted loading positioned and an extended dispensing position. The floor member has a single slot running its width through which one row of pill cavities empty when the floor member is extracted. The guides define positioning holes which allow the loader to be rapidly brought into position with respect to the automated pill dispenser drawer. The loader may be filled with pills at a location remote from the automated dispenser, and rapidly engaged with and removed from the dispenser to most effectively make use of the dispenser's processing time.

It is an object of the present invention to provide a loader for an automated pill dispenser which is easy to operate.

It is a further object of the present invention to provide a loader for an automated pill dispenser which is rapidly mounted to the pill dispenser without tools.

It is another object of the present invention to provide a loader for an automated pill dispenser which is of low cost and of high reliability.

Further objects, features and advantages of the invention will be apparent from the following detailed description when taken in conjunction with the accompanying drawings.

DESCRIPTION OF THE PREFERRED EMBODIMENTS

Referring more particularly to FIGS. 1–6, wherein like numbers refer to similar parts, a loader 20 for an automated pill dispenser 22 is shown in FIGS. 1–5. The loader 20 can be filled with individual charges of pills 24 at a location remote from the automated pill dispenser 22, and then rapidly emptied into the automated pill dispenser at the appropriate time.

Figure 1:
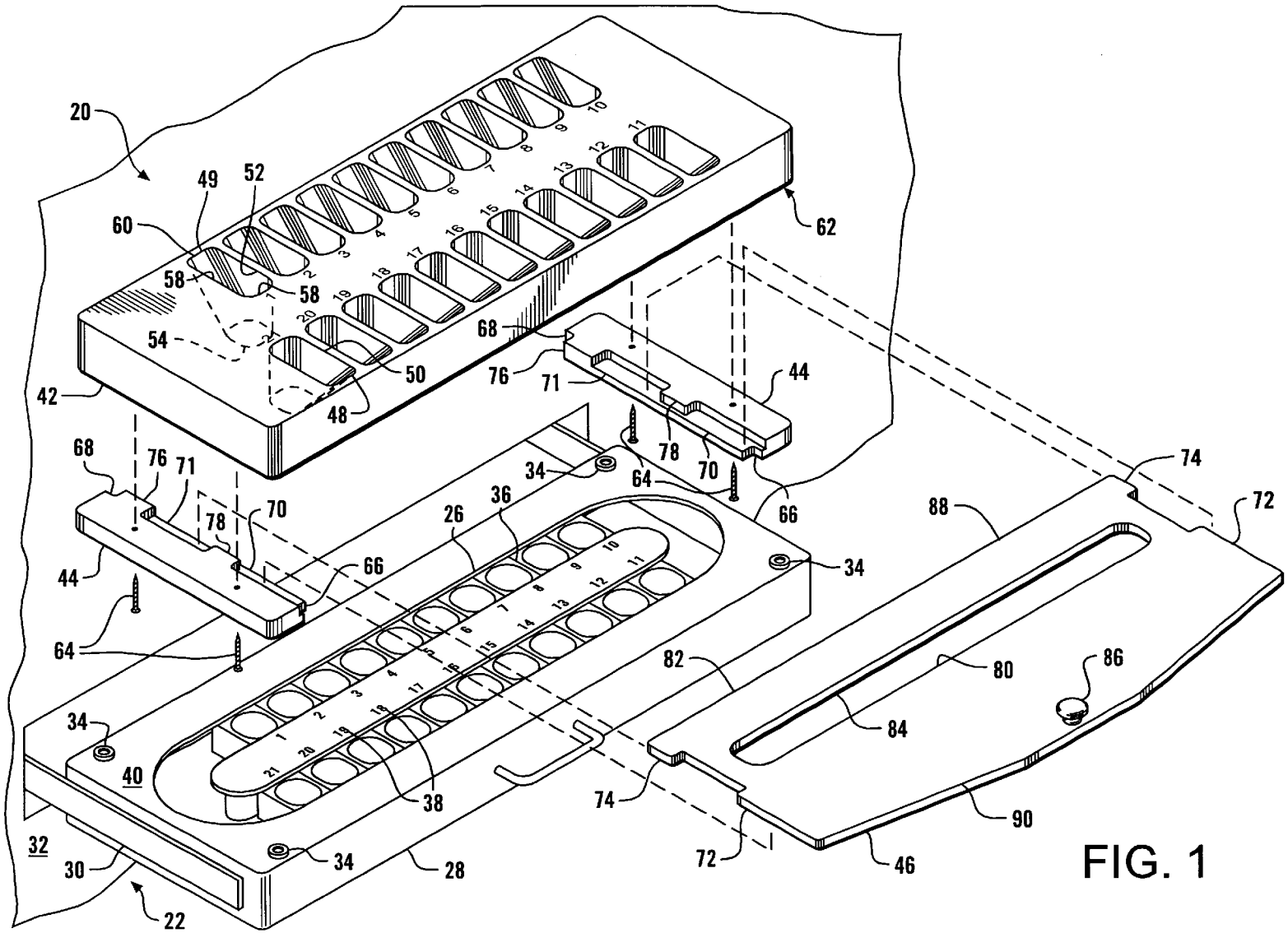
FIG. 1 is an exploded isometric view of the pill dispenser loader of this invention shown in relation to a conventional automated pill dispenser.

As shown in FIG. 1, a conventional automated pill dispenser 22 has extensive mechanized conveyor machinery for advancing precise numbers of pills of various types into patient-specific packaging. In addition to large capacity canisters for frequently requested pills, the automated pill dispenser 22 also has a specialty pill carousel 26 which is mounted within a retractable drawer 28 mounted on slides 30 which allow the carousel to be extracted from the main body 32 of the automated pill dispenser. The drawer 28 has a top wall 40 which has an oval opening and which is connected to the drawer by several upwardly projecting knurled mounting screws 34, two in front and is two in back.

The specialty pill carousel 26 is comprised of an endless looped chain of pill compartment blocks 36 which traverse an oval track under automated control to advance a particular pill compartment block 36 to machinery within the automated pill dispenser 22 which takes in the pills from the quantity contained within the compartment block. Each compartment block 36 has an initial position in which each compartment block is registered with respect to a marking 38 on the top wall 40 of the drawer 28. The markings 38 will typically be Arabic numbers arranged in two rows corresponding to the two rows of compartment blocks 36 within the oval track.

The loader 20 has a tray body 42 to which two guide members 44 are connected. The tray body 42 has portions which define two rows 48, 49 of pill cavities 50 which pass entirely through the tray body. The illustrated loader has ten pill cavities in the back row 49, and eleven pill cavities in the front row. It should be noted that the number of pill cavities will correspond to the number of pill block compartments, which can be as high as 61. Usually, there will be unequal numbers of pill cavities in each row, because there is a space in the carousel to unload the individual pill compartment blocks. A floor member 46 is engaged between the tray body 42 and the guide members 44 for slidable motion between a first position which allows loading of pills 24 into the pill cavities 50, and a second position which allows dispensing of the contents of the pill cavities into the pill compartment blocks 36. The tray body 42 and the guide members 44 and floor member 46 may be molded or machined plastic elements. For example, the tray body 42 and guide members 44 may be formed of ultra-high molecular weight polyethylene, such as TIVAR® 1000 plastic material (available from Poly Hi Solidur, Inc., 2710 American Way, Fort Wayne, Ind. 46809, www.polyhisolidur.com) which meets FDA guidelines for food handling and pharmaceutical processing. The floor member 42 may be formed from an acrylic material such as LUCITE® plastic.

Figure 2:
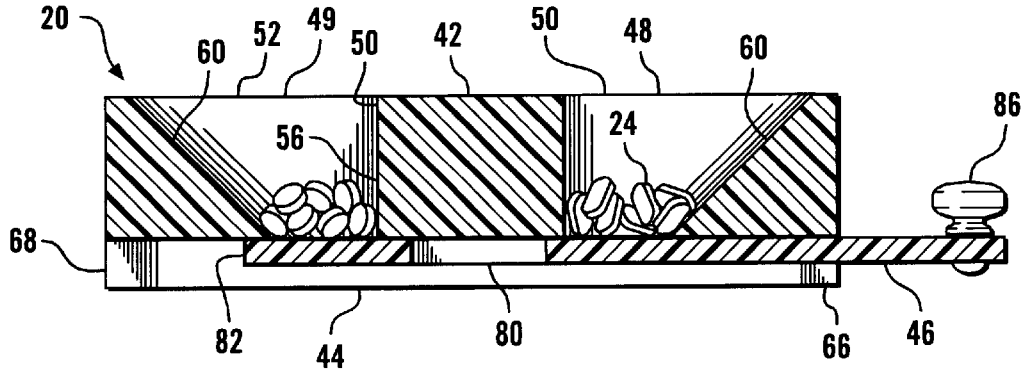
FIG. 2 is across-sectional view of the pill dispenser loader of FIG. 1 taken along section line 2—2, showing pills prior to being discharged from the loader.

As shown in FIG. 2, each pill cavity 50 has an upper inlet opening 52, through which pills are introduced into the pill cavity; and a lower outlet opening 54 through which pills are discharged from the loader 20. Each pill cavity 50 has a substantially vertical inner wall 56 and two outwardly extending substantially vertical side walls 58 which connect the inner wall 56 to an outer wall 60. The side walls may have a chamfered upper edge. The outer wall is sloped toward the lower outlet opening 54, for example, at about a 45 degree angle. The pill cavities 50 serve as funnels which direct pills toward the lower outlet openings 54. The vertical and steeply sloped walls of the cavities 50 are conducive to the ready flowing of the entire contents of the cavities through the outlet openings 54. The inlet opening 52 of a pill cavity 50 may be about 2 ⅝ inches in the front to back direction, and about 1 inch in the side to side direction, while each outlet opening 54 may be about 1⅛ inches in the front to back direction, and 1 inch in the side to side direction. The tray body is about 1½ inches tall.

Figure 5:
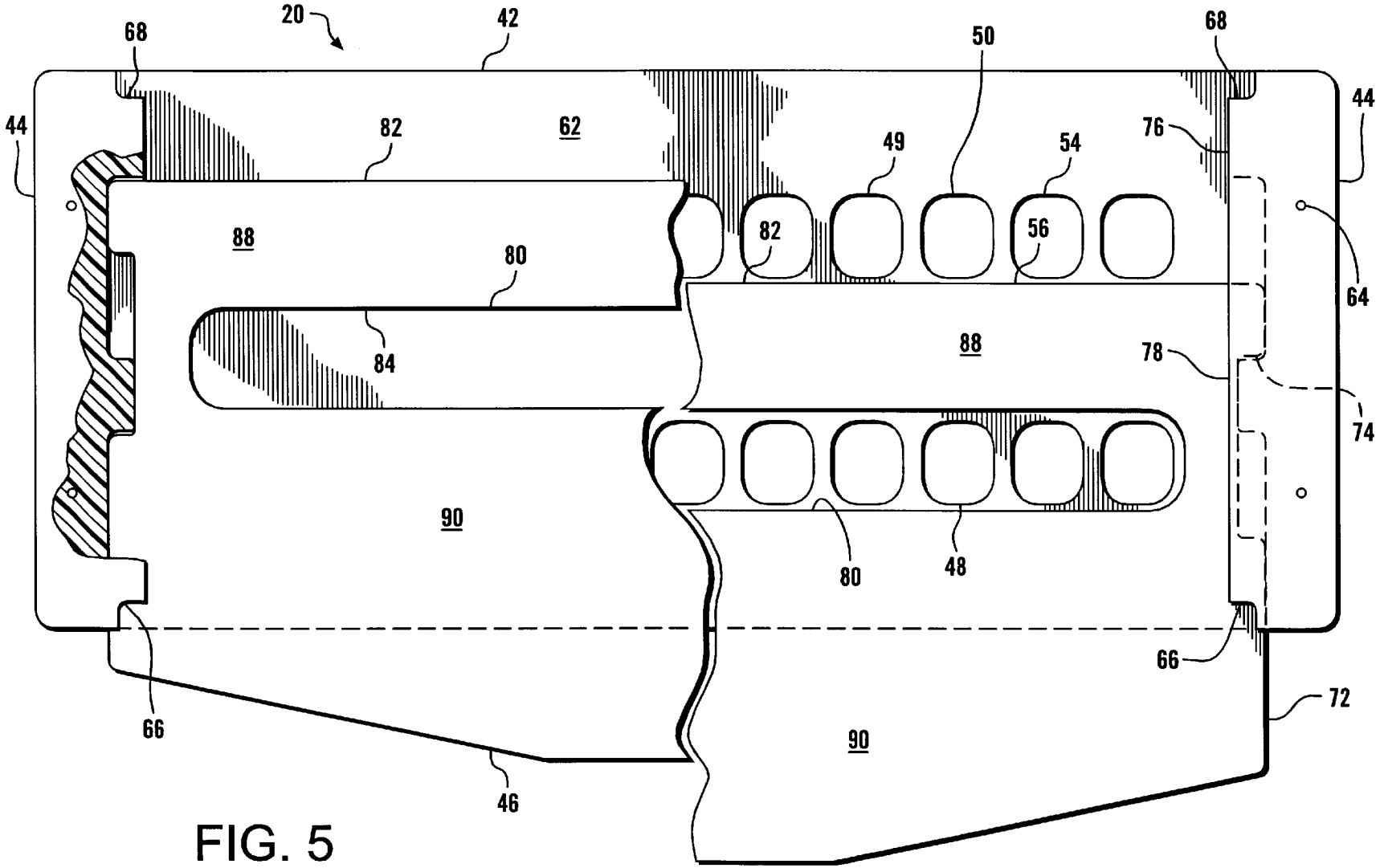
FIG. 5 is bottom plan view of the pill dispenser loader of FIG. 1 with the loader floor member being shown in fragmentary view on the left in a closed position, and in fragmentary view on the right in an open position.

As shown in FIG. 1, each guide member 44 is connected to the underside 62 of the tray body 42 by screw fasteners 64. A front positioning opening 66 and a rear positioning opening 68 is formed in each guide member 44. The positioning openings 66 are of a size and at a location to overlie the four knurled mounting screws 34 on the drawer 28. Thus when the loader 20 is set in place over the drawer 28, the positioning holes ensure that each pill cavity 50 overlies a pill compartment block 36. Two narrow aligned shelves 70, 71 are formed in each guide member 44. The floor member 46 has sidewardly extending front tabs 72 and rear tabs 74 which are received on the shelves 70, 71. Each guide member 44 has a rear stop 76 which terminates the rear shelf 71, and a middle stop 78 which terminates the front shelf 70. The floor member front tabs 74 are supported on the front shelves 70 and the rear tabs 74 are supported on the rear shelves 71. As shown in FIG. 5, the floor member 46 is movable between a loading position, shown on the left in FIG. 5, in which the floor member is fully retracted; and a dispensing position, shown on the right in FIG. 5, in which the floor member is fully extended.

A slot 80 extends through the floor member 46 and runs parallel to a rear edge 82 of the floor member. The slot defines a rear segment 88 which is rearward of the slot, and a front segment 90 which is frontward of the slot. The slot 80 has a width in the front to back direction which is at least as great as the width of the outlet openings 54 of the pill cavities 50 in the same direction. The distance between the rear edge 82 of the floor member 46 and the rear edge 84 of the slot 80 is great enough that in the loading position the slot does not underlie any pill cavity 50, and the floor member fully blocks any escape of pills 24 from the pill cavities. However, when the floor member is in the dispensing position, the slot 80 fully reveals all the outlet openings 54 of the pill cavities 50 in the front row 48 and the rear edge 82 of the floor member is positioned frontwardly of the back row 49 of pill cavities, fully revealing all the outlet openings 54 of the back row of pill cavities.

Figure 3:
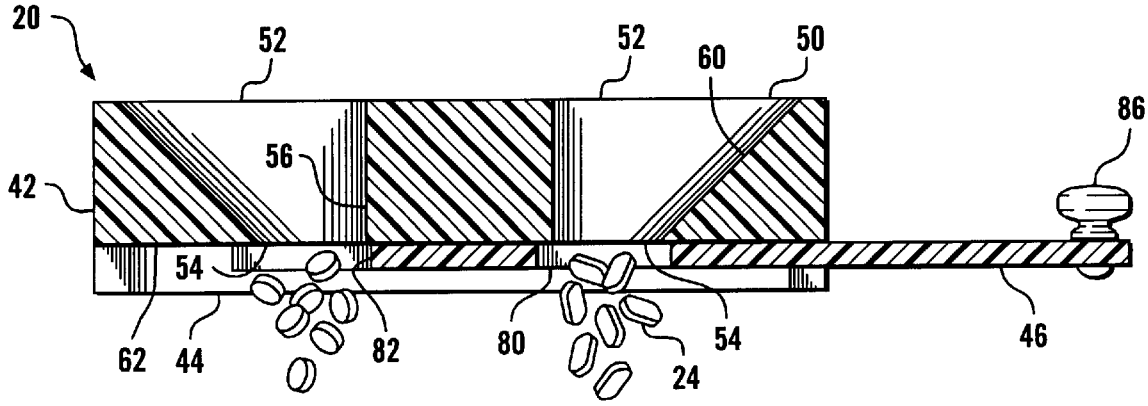
FIG. 3 is a cross-sectional view of the pill dispenser loader of FIG. 2 shown discharging pills.
Figure 4:
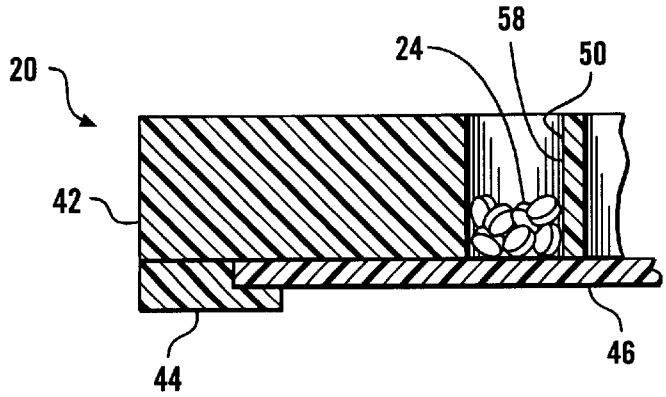
FIG. 4 is a cross-sectional view of the pill dispenser loader of FIG. 1 taken along section line 4—4.

As shown in FIG. 2, a knob or handle 86 is fastened to the floor member 46 at a segment of the floor member which protrudes frontwardly from the body 42 at all times. The operation of the loader 20 is illustrated in FIGS. 2–3. The loader 20 is first filled with pills. This filling may take place at a location remote from the automatic pill dispenser 22. Hence, an operator may at leisure charge the loader 20 with the required variety of pills while the dispenser 22 is processing prescriptions. Indeed, if desired, multiple loaders 20 maybe filled ahead of time for optimal usage of the automatic pill dispenser 22.

When the time arrives to add additional quantities of pills to the specialty pill carousel drawer 28 of the automated pill dispenser 22, the drawer 28 is extended, and the loader 20 is mounted to the drawer such that the four knurled fasteners 34 are received within the front positioning openings 66 and the rear positioning openings 68. As shown in FIG. 2, the floor member 46 is in the loading position when the loader 20 is first mounted to the extended drawer 28. The operator then grasps the handle 86 and pulls the floor member 46 frontwardly. In so doing, the rear segment 88 of the floor member 46 is moved frontwardly to reveal the back row 49 of pill cavities 50, and the slot 80 is advanced to reveal the front row 48 of pill cavities. As shown in FIG. 3, once the floor member 46 has been thus advanced to the dispensing position, the pills contained within the pill cavities 50 flow under the force of gravity out of the loader 20 and into the individual pill compartment blocks 36 of the carousel 26.

Complete removal of the floor member 46 from the loader is prevented by the engagement of the floor member rear tabs 74 with the middle stops 78 of the guide members 44. With all the pills 24 exhausted from the loader 20 into the automated pill dispenser 22, the loader may be lifted off the drawer 28 and returned for filling with additional pills. It should be noted that the rear stops 76 engage with the rear tabs of the floor member 46 when the floor member is returned to its loading position and ensure that the slot 80 is not pushed rearwardly too far.

It will be noted that the loader is rapidly and easily positioned on tie drawer 28 without the need for tools or operation of any fasteners. In just the same way, the loader is removed from the drawer 28 rapidly and simply without operation of any fasteners. The loader 20 thus presents a time-saving, precise, and easy to operate means of carrying a variety of pills to desired pill compartment blocks within the automated pill dispenser. Increased speed in loading the automated pill dispenser 22 translates to less down time for the automated pill dispenser, and more efficient use of the capital invested in the automated pill dispenser.

Figure 6:
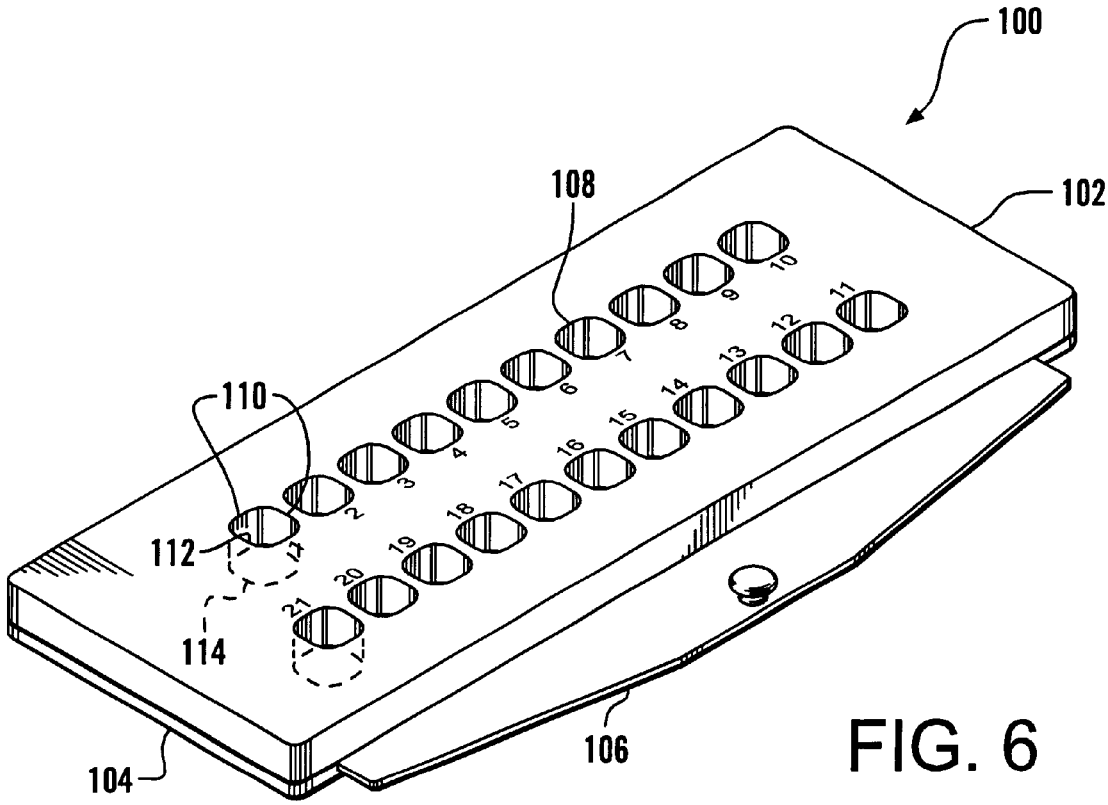
FIG. 6 is an isometric view of an alternative embodiment pill dispenser loader of this invention having a shallower profile.

An alternative embodiment loader 100 of this invention is shown in FIG. 6. The loader 100 is adapted for loading directly by hand, and hence eliminates the funnel shape of the pill cavities of the loader 20. The loader 100 thus has a shallower tray body 102, and shallower guide members 104 and floor member 106. The pill cavities 108 are generally square with rounded comers, and have four substantially vertical side walls 110. The inlet openings 112 are thus approximately the same size as the outlet openings 114 of the pill cavities. It should be noted that the pill cavities 108 are preferably smaller than the openings in the pill compartment blocks, to facilitate entry of the pills into the pill compartment blocks.

It should be noted that wherever the term "pill" is used herein, any solid form medicament or pharmaceutical product is intended to be encompassed including capsules, lozenges, and caplets.

It is understood that the invention is not limited to the particular construction and arrangement of parts herein illustrated and described, but embraces all such modified forms thereof as come within the scope of the following claims.

I claim:

1. A device for simultaneously loading multiple quantities of pills of different kinds into an automated pill dispenser, the device comprising:

a tray body, the tray body having portions which define a plurality of pill cavities arrayed in at least two rows comprising a front row and a back row, each pill cavity having an upper inlet opening and a lower outlet opening; and a floor member slidably engaged beneath the tray body for movement between a first position in which the floor member blocks escape of pills from the tray body pill cavities, to a second position in which pills are free to escape from the tray body, the floor member having portions defining a rear edge and a slot spaced frontwardly from the rear edge, wherein in the first position the slot is positioned between the outlet openings of the front row and the outlet openings of the back row, and the rear edge is positioned rearwardly of the outlet openings of the back row, and wherein in the second position the rear edge is positioned frontwardly of the outlet openings of the back row and the slot is positioned beneath the outlet openings of the front row to allow discharge of the contents of all the pill cavities of the tray body through the outlet openings.

2. The device of claim 1 wherein the pill cavity inlet openings are larger than the pill cavity outlet openings.

3. The device of claim 2 wherein the each pill cavity is defined between an inner wall and an outer wall which are joined by two spaced side walls, the outer wall being inclined inwardly.

4. The device of claim 1 wherein the floor member is engaged between the tray body and two guide members, the guide members having portions which extend beneath the floor member but which do not obstruct the outlet openings.

5. The device of claim 4 wherein the floor member has at least two sidewardly extending tabs, and wherein a first stop and a second stop are formed on each guide member, the second stop being forward of the first stop, such that the forward and rearward travel of the floor member is restrained by engagement between the tabs and the stops.

6. The device of claim 1 wherein the device has portions defining at least two upwardly opening positioning openings, the positioning openings spaced from one another and serving to repeatedly position the device with respect to the carousel loading assembly of an automated pill dispenser apparatus.

7. A loader for simultaneously discharging a plurality of quantities of pills into a plurality of compartments within an automated pill dispenser, the loader comprising:

a tray body, the tray body having portions which define a plurality of pill cavities arrayed in at least two rows comprising a front row and a back row, each pill cavity having an upper inlet opening and a lower outlet opening; and a floor member slidably engaged beneath the tray body for movement between a first position in which the floor member blocks escape of pills from the tray body pill cavities, to a second position in which pills are free to escape from the tray body, the floor member having portions defining a rear edge and a slot spaced frontwardly from the rear edge, wherein in the first position the slot is spaced from the outlet openings, and wherein in the second position the slot is positioned beneath the outlet openings of the front row, and the floor member does not obstruct the outlet openings of the back row to allow discharge of the contents of all the pill cavities of the tray body through the outlet openings.

8. The loader of claim 7 wherein the pill cavity inlet openings are larger than the pill cavity outlet openings.

9. The loader of claim 8 wherein the each pill cavity is defined between an inner wall and an outer wall which are joined by two spaced side walls, the outer wall being inclined inwardly.

10. The loader of claim 8 wherein the floor member is engaged between the tray body and two guide members, the guide members having portions which extend beneath the floor member but which do not obstruct the outlet openings.

11. The loader of claim 10 wherein the floor member has at least two sidewardly extending tabs, and wherein a first stop and a second stop are formed on each guide member, the second stop being forward of the first stop, such that the forward and rearward travel of the floor member is restrained by engagement between the tabs and the stops.

12. The loader of claim 8 wherein the device has portions defining at least two upwardly opening positioning openings, the positioning openings spaced from one another and serving to repeatedly position the device with respect to the carousel loading assembly of an automated pill dispenser apparatus.

13. The loader of claim 8 wherein in the number of pill cavities in the back row is less than the number of pill cavities in the front row.

14. A device for simultaneously loading multiple quantities of pills of different kinds into an automated pill dispenser, the device comprising:

a tray body, the tray body having portions which define a plurality of pill cavities arrayed in at least two rows comprising a front row and a back row, each pill cavity having an upper inlet opening and a lower outlet opening; and a floor member slidably engaged beneath the tray body for movement between a first position in which the floor member blocks escape of pills from the body pill cavities, to a second position in which pills are free to escape from the tray body, the floor member having portions defining a front segment which underlies the outlet openings of the back row in the first position, and the floor member has, betwen the front segment and the rear segment, portions through which pills can escape through the floor member, such that when the floor member is in the second position, the contents of the pill cavities can pass from the outlet openings through the floor member.

15. The loader of claim 14 wherein in the number of pill cavities in the back row is less than the number of pill cavities in the front row.

16. A loader for simultaneously discharging a plurality of quantities of pills into a plurality of compartments within an automated pill dispenser, the loader comprising:

a tray body, the tray body having portions which define a plurality of pill cavities arrayed in at least two rows comprising a front row and a back row, each pill cavity having an upper inlet opening and a lower outlet opening; and a floor member slidably engaged beneath the tray body for movement between a first position in which the floor member blocks escape of pills from the tray body pill cavities, to a second position in which pills are free to escape from the tray body, the floor member having portions defining a rear segment, and a front segment spaced frontwardly from the rear segment, wherein in the first position the rear segment blocks escape of pills from the back row, and the front segment blocks escape of pills from the front row, and wherein in the second position the rear segment of the floor member is moved frontwardly to reveal the back row of pill cavities and the front row of cavities is revealed, to allow discharge of the contents of all the pill cavities of the tray body through the outlet openings.

17. The loader of claim 16 wherein in the number of pill cavities in the back row is less than the number of pill cavities in the front row.

* * * * *